US005991555A

United States Patent [19]

Suzumi et al.

[11] Patent Number: 5,991,555

[45] Date of Patent: Nov. 23, 1999

[54] IMAGE FORMING APPARATUS

[75] Inventors: Masahiko Suzumi, Numazu; Masahiro Goto; Hiroto Hasegawa, both of Mishima, all of Japan

[73] Assignee: Canon Kabushiki Kaisha, Tokyo, Japan

[21] Appl. No.: 09/151,724

[22] Filed: Sep. 11, 1998

[30] Foreign Application Priority Data

Sep. 12, 1997 [JP] Japan ..... 9-248526

[51] Int. Cl.[6] ..... G03G 15/00

[52] U.S. Cl. ..... 399/18; 399/33; 399/69

[58] Field of Search ..... 399/18, 33, 45, 399/68, 67, 69, 19, 23, 66, 16; 219/216; 271/2, 258.01, 260, 262

[56] References Cited

U.S. PATENT DOCUMENTS

| | | | |
|---|---|---|---|
| 4,373,801 | 2/1983 | Itoh | 399/45 |
| 4,496,238 | 1/1985 | Tsukada et al. | 399/18 |
| 5,503,382 | 4/1996 | Hansen et al. | 271/3.03 |
| 5,512,992 | 4/1996 | Kim et al. | 399/69 |
| 5,621,504 | 4/1997 | Wakamatsu et al. | 399/1 |
| 5,626,077 | 5/1997 | Muller | 101/484 |
| 5,689,760 | 11/1997 | Suzuki et al. | 399/45 |
| 5,809,367 | 9/1998 | Yoo et al. | 399/45 |

*Primary Examiner*—Robert Beatty
*Attorney, Agent, or Firm*—Fitzpatrick, Cella, Harper & Scinto

[57] ABSTRACT

An image forming apparatus has an image forming unit for forming an image on a recording material, a fixing device for fixing the image on the recording material, an overlap-feed detector such as a transfer current detector for detecting an overlap-feed of the recording material conveyed to the fixing device and a set temperature controller for controlling the set temperature. The fixing device is maintained at a set temperature during an image fixing operation. The controller lowers the set temperature or stops the conveyance of the recording material when the overlap-feed detector detects the overlap feed. Accordingly, the image forming apparatus can prevent a fixing device from breaking due to an overlap-feed of a recording material.

38 Claims, 11 Drawing Sheets

IMAGE FORMING APPARATUS

BACKGROUND OF THE INVENTION

1. Field of the Invention

The present invention relates to an image forming apparatus using an electronic photographic method, an electrostatic recording method or the like.

More preferably, the present invention relates to an image forming apparatus forming and carrying a toner image corresponding to an aimed image information on an image carrying material such as an electronic photographic photosensitive material, an electrostatic recording dielectric material or the like in accordance with a suitable image forming process such as an electronic photographic process, an electrostatic recording process or the like, and provided with a transfer member for transferring the toner image to a transfer material and a contact heating type fixing apparatus for making the toner image on the transfer material a permanent fixing image.

2. Related Background Art

Conventionally, an image forming apparatus using an electronic photographic method such as a laser beam printer or the like receives a command relating to a printing, a coded letter and an image information as a data by means of an external information processing device such as a computer or the like, and an image having a concentration information such as a photography or the like is performed a known image processing such as an error diffusion method or the like and is converted into an image information made binary.

Next, the image information is printed in an electronic photographic engine portion. FIG. 12 shows a schematically cross sectional view of the electronic photographic engine portion in accordance with the conventional art.

The electronic photographic engine portion is structured such that a primary charging unit 2 for charging a photosensitive drum (a photosensitive material) 1 as an image carrying material along a rotational direction thereof, exposing means 3 for exposing the photosensitive drum 1 and forming an electrostatic latent image, a developing device 4 for attaching a toner (a developer) to the electrostatic latent image and forming a toner image, a transfer roller (a transfer device) 5 for transferring the toner image on the photosensitive drum 1 to a transfer material P and a cleaning device 7 for removing a residual toner are arranged in a periphery of the photosensitive drum 1. The transfer material P corresponding to a transfer target of the toner image is supplied and conveyed from a sheet cassette (not shown) to the photosensitive drum 1. The transfer material P supplied to the photosensitive drum 1 is transferred the toner image by the transfer roller (the transfer device) 5, and thereafter, conveyed to a fixing device 6, and here, the transfer material P on which the toner image is fixed is discharged out of the apparatus.

Next, the roller transfer device 5 will be described below.

The transfer roller device 5 is structured such as to absorb and transfer the toner image in the side of the photosensitive drum 1 to a surface side of the transfer material P in an electrostatic manner by applying a voltage having a reversed polarity against the toner to the transfer roller 5 while the transfer material P is held between and conveyed by an electric conductive elastic roller (the transfer roller 5) and the photosensitive drum 1.

As a method of controlling a transfer voltage, in order to prevent a poor transfer and a track of a paper on the photosensitive drum 1 caused by a change in resistance of the transfer roller 5 or the like, there has been known an active transfer voltage control (ATVC) for estimating a resistance of the transfer roller and suitably controlling a transfer voltage as disclosed in Japanese Patent Application Laid-Open No. 2-123385.

Since the ATVC is structured such as to flow a desired constant current from the transfer roller to the photosensitive drum during a preliminary rotating process of the image forming apparatus, estimate a resistance of the transfer roller 5 on the basis of a bias voltage at that time and apply a constant voltage bias corresponding to the resistance to the transfer roller 5 as a transfer bias at a time of transferring in the printing process, a poor transfer, a track of a paper and the like can be prevented.

On the contrary, as a heating and fixing device for fixing the toner image transferred on the transfer material as a permanent fixing image, a device of a thermal roller type or a film heating type is widely used. Particularly, as a film heating type, there is a method in which an electric power is not supplied to the heating and fixing device at a time of stand-by and a consumptive electric power is restricted as little as possible. Specifically, a heating and fixing method in accordance with a film heating type of fixing a toner image on a recording material between a heater portion and a pressing roller through a film is suggested in Japanese Patent Application Laid-Open Nos. 63-313182, 2-157878, 4-44075 and 4-204980. FIG. 13 is a schematic view of a main portion of the apparatus. Accordingly, in FIG. 13, the apparatus has a heating member (a heating material, hereinafter refer to a heater) 101 fixed and supported to a stay holder (a supporting material) 102, and an elastically pressing roller 110 press-contacted by forming a nip portion (a fixing nip portion) N with a preset or predetermined nip width with holding a heat resisting thin film (hereinafter, refer to a fixing film) 103 in the heater 101.

The heater 101 is heated by turning on electricity and is adjusted to a preset temperature. The fixing film 103 is a web-like member with an end formed in a cylindrical shape, an endless belt shape or a roll winding shape and conveyed in a direction of an arrow a while being brought into close contact with and sliding on a surface of the heater 101 in a fixing nip portion N by drive means (not shown) or a rotating force of the pressing roller 110.

In a state of heating the heater 101 and adjusting to a preset temperature, and conveying and moving the fixing film 103 in a direction of an arrow, when the transfer material (the recording material) P on which a unfixed toner image t as a heated material is formed and carried is introduced between the fixing film 103 in the fixing nip portion N and the pressing roller 110, the transfer material P is brought into close contact with the surface of the fixing film 103 and carried and conveyed in the fixing nip portion N together with the fixing film 103. In this fixing nip portion N, the transfer material P and the toner image t are heated by the heater 101 via the fixing film 103, so that the toner image t on the recording material P is heated and fixed. The recording material portion passing through the fixing nip portion N is pealed from the surface of the fixing film 103 and conveyed.

A ceramic heater is generally used for the heater 101 as the heating member. For example, the ceramic heater is structured such as to form a current-carrying and heat generating resistance layer 101*b* such as a silver palladium (Ag/Pb), Ta2N or the like on a surface of a ceramic substrate 101*a* with an electrical insulating characteristic, a good thermal conductivity and a low thermal capacity such as an alumina or the like (a surface in the side opposing to the fixing film 103) along a longitudinal direction of a substrate (a direction perpendicular to the drawing) by means of a screen printing or the like, and cover the heat generating resistance layer forming surface with a thin glass protecting layer 101*c*. The ceramic heater 101 is structured such that the current-carrying heat generating resistance layer 101*b* is heated by turning on electricity to the current-carrying heat generating resistance layer 101*b* and the whole heater quickly heat the ceramic substrate 101*a* and the glass protecting layer 101*c*. The temperature increase of the heater 101 is detected by temperature detecting means 104 disposed at the back surface of the heater and fed back to a current-carrying control portion (not shown). The current-carrying control portion controls a current-carrying with respect to the current-carrying heat generating resistance layer 101*b* in such a manner that a heater temperature detected by the temperature detecting means 104 is maintained at a preset substantially constant temperature (a fixing temperature). Accordingly, the heater 101 is heated and adjusted to a preset fixing temperature.

The fixing film 103 is structured such that in order to effectively give the heat of the heater 101 to the transfer material P as the heated material in the fixing nip portion N, a thick thereof is set to be significantly thin to a level of 20 to 70 $\mu$m. The fixing film 103 is constructed by three layers comprising a film base layer, a primer layer and a mold releasing layer, in which a side of the film base layer is a side of the heater and a side of the mold releasing layer is a side of the pressure roller. The film base layer is made of a polyimide, a polyamide, a PEEK (a polyether ether ketone) or the like having a higher insulation performance than the glass protecting layer 101*c* of the heater 101, and has a heat resisting performance and a high elasticity. Further, a mechanical strength such as a tensile strength and the like of the whole fixing film 103 is maintained by the film base layer. The primer layer is formed by a thin layer having a thickness of about 2 to 6 $\mu$m. The mold releasing layer corresponds to a toner offset prevention layer with respect to the fixing film 103, and is formed by coating with a fluorocarbon resin such as a perphloroalkoxide (PFA), a polytetrafluoroethylene (PTFE), an ethylene propylene fluoride (FEP) or the like at a thickness of about 10 $\mu$m.

Further, the stay holder 102 is formed by, for example, a heat resisting plastic member, and serves as a conveyance guide for the fixing film 103 as well as holding the heater 101. In the heating apparatus of the film heating type using the thin film 103 for fixing, since a rigidity of the ceramic heater 101 as the heating member is high, the pressing roller 110 having the elastic layer 111 becomes flat at the pressing portion in correspondence to the flat lower surface of the heater 101 press-contacted thereto and forms the fixing nip portion N having a preset width. In accordance with this structure, a heating and fixing in correspondence to the quick start is realized by heating only the fixing nip portion N.

In the heating and fixing device mentioned above, in the case that the transfer materials such as small-sized papers, for example, envelopes or the like are conveyed in an overlap manner, near an end portion of the papers conveyed in an overlap manner as shown in FIG. 4B, there is a case that a gap is generated between the ceramic heater and the pressing roller. In the case that the gap is generated in this manner, a heat of the ceramic heater does not escape to the pressing roller at that portion, so that a high temperature is locally generated. Accordingly, there has been a case that the film guide is melted and the ceramic heater is broken and deteriorated.

SUMMARY OF THE INVENTION

The present invention is made by taking the problems mentioned above into consideration, and an object of the present invention is to provide an image forming apparatus which can prevent a fixing device from breaking due to an overlap-feed of a recording material.

Another object of the present invention is to provide an image forming apparatus comprising:

image forming means for forming an image on a recording material;

fixing means for fixing the image on the recording material, the fixing means being maintained at a set temperature during an image fixing operation;

overlap-feed detecting means for detecting an overlap-feed of the recording material conveyed to the fixing means; and set temperature control means for controlling the set temperature, the control means descending the set temperature when the overlap-feed detecting means detects the overlap feed.

The other object of the present invention is to provide an image forming apparatus comprising:

image forming means for forming an image on a recording material;

fixing means for fixing the image on the recording material;

overlap-feed detecting means for detecting an overlap-feed of the recording material conveyed to the fixing means; and conveyance control means for controlling a conveyance of the recording material, the conveyance control means stopping the conveyance of the recording materials when the overlap-feed detecting means detects the overlap feed.

The other object of the present invention is to provide an image forming apparatus comprising:

image forming means for forming an image on a recording material, the image forming means having a transfer member for transferring the image on the recording material;

fixing means for fixing the image on the recording material, the fixing means being maintained at a set temperature during an image fixing operation;

set temperature control means for controlling the set temperature, the control means setting the set temperature in accordance with an amount of current flowing to the transfer member at a time of transferring the image on the recording material.

The other object of the present invention is to provide an image forming apparatus comprising:

image forming means for forming an image on a recording material, the image forming means having a transfer member for transferring the image on the recording material;

fixing means for fixing the image on the recording material; and conveyance control means for controlling a conveyance of the recording material, the conveyance control means controlling the conveyance of the recording materials in accordance with an amount of current flowing to the transfer member at a time of transferring the image on the recording material.

The other object of the present invention is to provide an image forming apparatus comprising:

image forming means for forming an image on a recording material, the image forming means having a transfer member for transferring the image on the recording material;

fixing means for fixing the image on the recording material, the fixing means being maintained at a set temperature during an image fixing operation;

set temperature control means for controlling the set temperature, the control means setting the set temperature in accordance with an amount of voltage applied to the transfer member at a time of transferring the image on the recording material.

The other object of the present invention is to provide an image forming apparatus comprising:

image forming means for forming an image on a recording material, the image forming means having a transfer member for transferring the image on the recording material;

fixing means for fixing the image on the recording material;

conveyance control means for controlling a conveyance to the recording material, the control means controlling the conveyance of the recording material in accordance with an amount of voltage applied to the transfer member at a time of transferring the image on the recording material.

The other objects of the present invention will be apparent by reading the following description with reference to the accompanying drawings.

DETAILED DESCRIPTION OF THE PREFERRED EMBODIMENTS

First Embodiment

An embodiment in accordance with the present invention will be described below.

(1) Embodiment of Image Forming Apparatus

Figure 1:
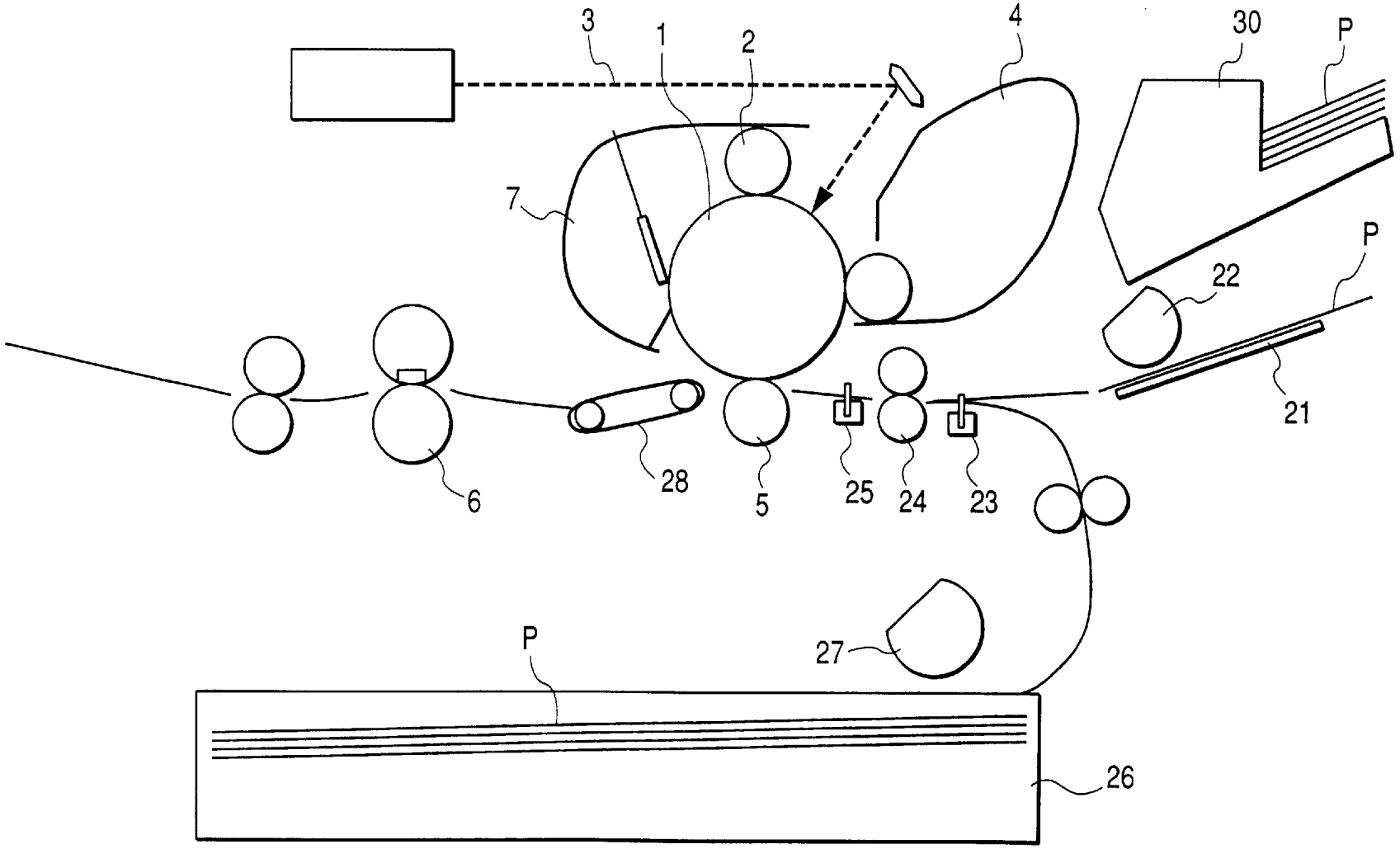
FIG. 1 is a schematic view of an image forming apparatus in accordance with the present invention.

At first, FIG. 1 is a schematic view of an image forming apparatus in accordance with the present invention.

In FIG. 1, reference numeral 1 denotes a photosensitive drum as an image carrying material, in which a photosensitive material such as an OPC, an amorphous Se, an amorphous Si or the like is formed on a grounded cylindrical substrate such as an aluminum, a nickel or the like. The photosensitive drum 1 is rotated in a direction of an arrow, and at first, a surface thereof is uniformly charged by a charging roller 2 corresponding to a charging device. Next, a scanning exposure by means of a laser beam 3 controlled between an ON state and an OFF state in accordance with an image information is performed, so that an electrostatic latent image is formed. The electrostatic latent image is developed and made visible in a developing device 4. As a developing method, a jumping developing method, a two-component developing method, an FEED developing method or the like is used, and an image exposure and a reversed development are frequently used in a combined manner.

A toner image made visible is transferred on a transfer material P conveyed by a transfer roller 5 corresponding to a transfer member of the transfer device at a preset timing from the photosensitive drum 1 in a transfer nip portion. At this time, the transfer material (a recording material) P is held between the photosensitive drum 1 and the transfer roller 5 in the transfer nip portion (a transfer position) due to a constant pressing force and conveyed. The transfer material P on which the toner image is transferred is conveyed to a fixing device 6, and is fixed as a permanent image. On the contrary, a residual toner left on the photosensitive drum 1 after transferring is removed from a surface of the photosensitive drum 1 by means of a cleaning device 7. In this case, the image forming apparatus in accordance with this embodiment can print at a speed of 600 dpi and 16 sheets per minute (a process speed of about 94 mm/sec).

(2) Transfer Roller 5

Figure 2:
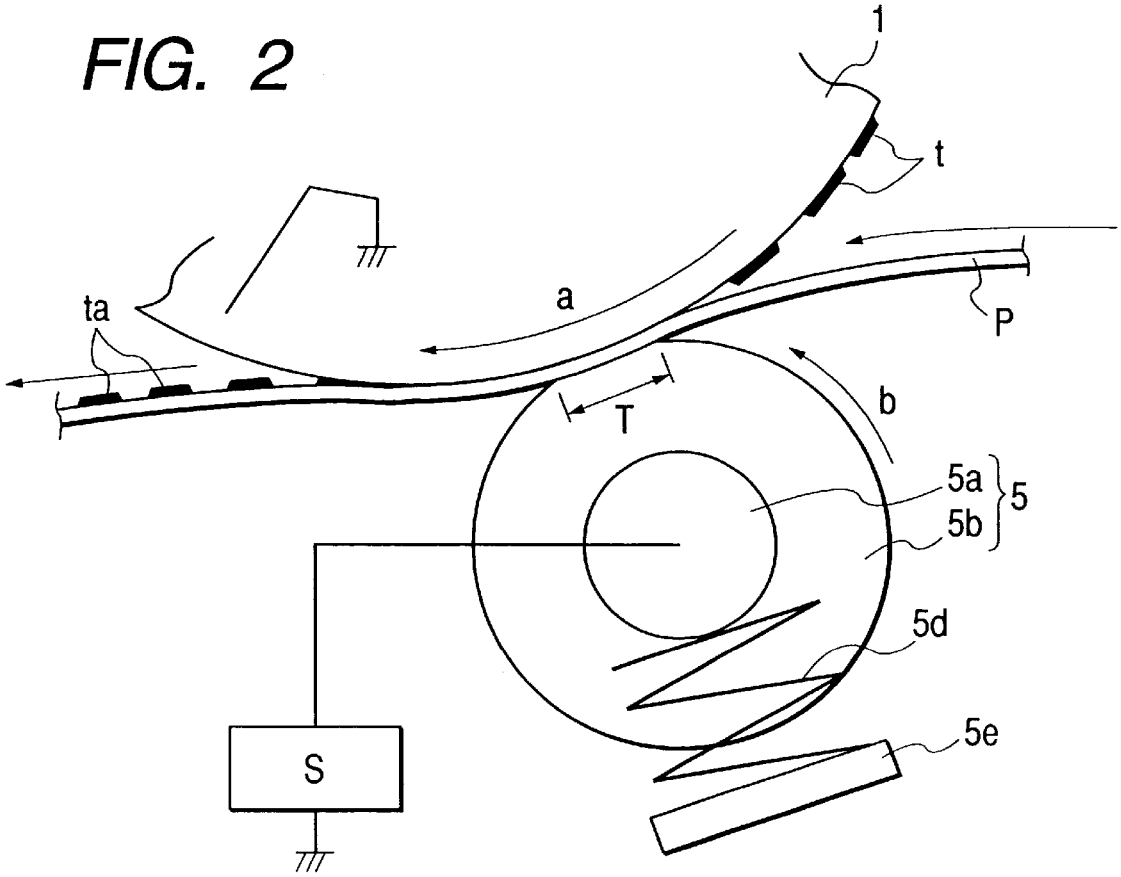
FIG. 2 is an enlarged schematic view of a transfer roller portion in accordance with a first embodiment.

FIG. 2 is an enlarged schematic view of the transfer roller 5.

The transfer roller 5 is a roller structured such that an elastic material in a solid state or in a sponge state by foaming such as an EPDM (an ethylene propylene rubber), a silicon, an NBR (a nitrile butadiene rubber), a urethane or the like is formed on a core metal 5*a* such as an iron, an SUS or the like as an elastic layer 5*b*. The transfer roller 5 is provided in the photosensitive drum 1 in a pressing manner with a preset pressing force by means of a pressing spring 5*d* provided between the core metal 5*a* and a fixed spring receiver 5*e* in a compressed manner, and a transfer nip portion T with a preset width is formed with respect to the photosensitive drum 1 due to an elastic deformation of the elastic member layer 5*b*.

It is preferable to use the material having a roller hardness of 30 to 70 degrees (Asker-C, at a time of applying a load of 1 kg) and a resistance of a range between $10^6$ to $10^{10}$ Ω. When the resistance is smaller than $10^6$ Ω, a difference between the transfer currents respectively flowing through a white portion (a background portion) and a black portion (a toner attachment portion), so that an amount of an electric charge transferring to the white portion is larger than an amount of an electric charge transferring to a black portion (a toner image portion) and the toner is attracted to the white portion due to an electric field, whereby a scattering of the toner is generated. When the resistance is larger than $10^{10}$ Ω, the transfer voltage necessary for supplying a sufficient transfer current to the paper becomes too high, so that it is hard to secure a distance along the surface sufficient for preventing a leakage at a contact portion on the high pressure substrate. In this case, a method of measuring the resistance is performed by bringing the transfer roller into contact with an Al (aluminum) drum (having the same shape as that of the photosensitive drum), and the resistance is defined by an amount of current flowing through the Al drum at a time of applying a voltage of 1 kv.

Further, the transfer voltage is applied to the transfer roller 5 in accordance with the ATVC control in order to prevent a poor transfer and a scattering.

A method of the ATVC control is as follows.

When the transfer material is not in the transfer nip portion, the transfer roller 5 is controlled to be a constant current by means of a power source S. The transfer roller 5 is controlled to be a constant voltage by means of the power source S at a time of transferring the toner image on the transfer material, on the basis of a voltage in correspondence to the voltage supplied to the transfer roller 5 when the constant current control is performed. Accordingly, since the resistance of the transfer roller 5 is changed in correspondence to a change of environment, a voltage applied to the transfer roller 5 at a time of transferring the image is determined in such a manner as to compensate the resistance change. Here, in the case that a lack of uniformity of the resistance exists in a peripheral direction of the transfer roller 5, it is preferable to determine a voltage for controlling to be a constant voltage in correspondence to the voltage during the constant current control corresponding to a periphery or more of the transfer roller 5.

On the contrary, the transfer roller 5 is controlled to be a constant voltage when the transfer material does not exist in the transfer nip portion, and at this time, the voltage for the constant voltage control at a time of transferring the image may be determined in correspondence to the current flowing through the transfer roller 5. As mentioned above, a resistance change of the transfer roller 5 can be estimated by detecting the current flowing through the transfer roller 5. Accordingly, the resistance of the transfer roller 5 can be estimated by detecting a characteristic between a voltage and a current of the transfer roller 5 when the transfer material does not exist in the transfer nip portion.

(3) Heating and Fixing Device 6

Figure 3:
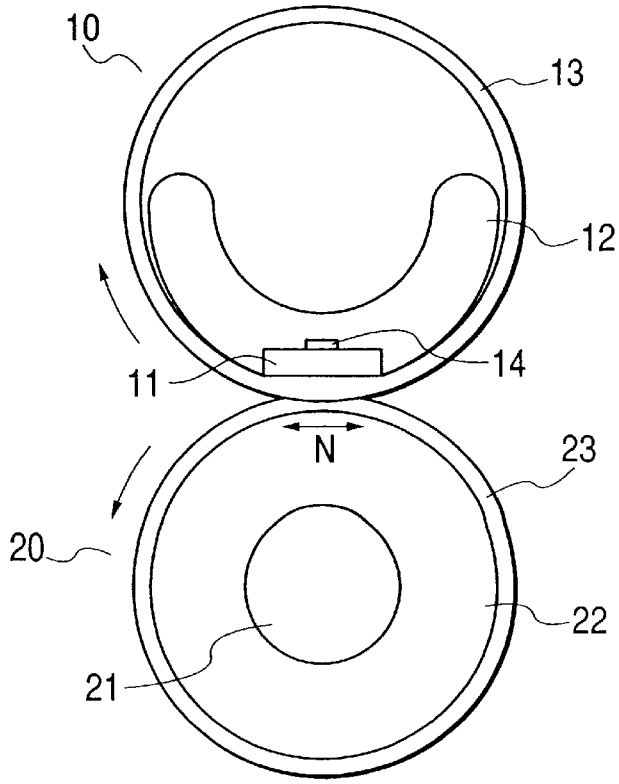
FIG. 3 is a schematic view which shows a heating and fixing device in accordance with the first embodiment.

FIG. 3 shows cross sectional structure of a heating and fixing device 6. In FIG. 3, a fixing member 10 is constituted by the following members. Reference numeral 13 denotes a fixing film having a small thermal capacity, which preferably has a thickness equal to or less than 100 μm so as to enable a quick start, and is a film having a heat resistance and a flexibility and made of a polyimide, a polyamide imide, a PEEK, a PES (a polyether sulfone), a PPS (a polyphenylene sulfide), a PFA, a PTFE, an FEP or the like. Further, a thickness equal to or more than 20 μm is preferable for a film sufficient for constructing the heating and fixing device with a long life and having an excellent durability. Accordingly, a range which is not less than 20 μm and not more than 100 μm is optimum as a thickness of the fixing film 13. Further, in order to prevent an offset and secure a separation performance of the recording material, a front layer is coated with a heat resisting resin having a good mold releasing performance such as a PFA, a PTFE, an FEP or the like in a mixed or single manner. Still further, reference numeral 11 denotes a heating heater provided within the fixing film 13, which heats the nip portion melting and fixing the toner image on the recording material through the fixing film 13. Reference numeral 12 denotes an adiabatic stay holder for holding the heating heater 11 and preventing the heat from discharging in a direction opposite to the nip, which is formed by a liquid crystal polymer, a phenol resin, a PPS, a PEEK or the like and to which the fixing film 13 is loosely fitted with room outwardly and arranged in such a manner as to freely rotate in a direction of an arrow. Further, since the fixing film 13 rotates while being brought into slide contact with and guided along the heating heater 11 and the adiabatic stay holder 12 disposed therewithin, it is necessary to restrict a frictional resistance between the heating heater 11 and the adiabatic stay holder 12, and the fixing film 13 small. For this purpose, a small amount of lubricant such as a heat resisting grease or the like is interposed on the surface of the heating heater 11 and the adiabatic stay holder 12. The heater 11 is heated and adjusted to a preset temperature by turning on electricity. Accordingly, the fixing film 13 can smoothly rotate.

A pressing member (a pressing roller) 20 is constituted by an elastic layer 22 formed by a heat resisting rubber such as a silicon rubber, a fluorine rubber or the like on an outer side of a core metal 21, and a mold releasing layer such as a PFA, a PTFE, an FEP or the like may be formed thereon. The pressing member 20 is pressed by pressing means (not shown) in a direction of the fixing member 10 mentioned above sufficiently so as to form a nip portion necessary for heating and fixing from both end portions in a longitudinal direction, and is rotated in a direction of an arrow in accordance with a rotation (not shown) from the end portion in a longitudinal direction through the core metal 21. Accordingly, the fixing film 13 mentioned above is driven and rotated in a direction of an arrow in the drawing outside the stay holder 12. Otherwise, a drive roller (not shown) is provided inside the fixing film 13 and the fixing film 13 is rotated by rotating the drive roller.

Figure 13:
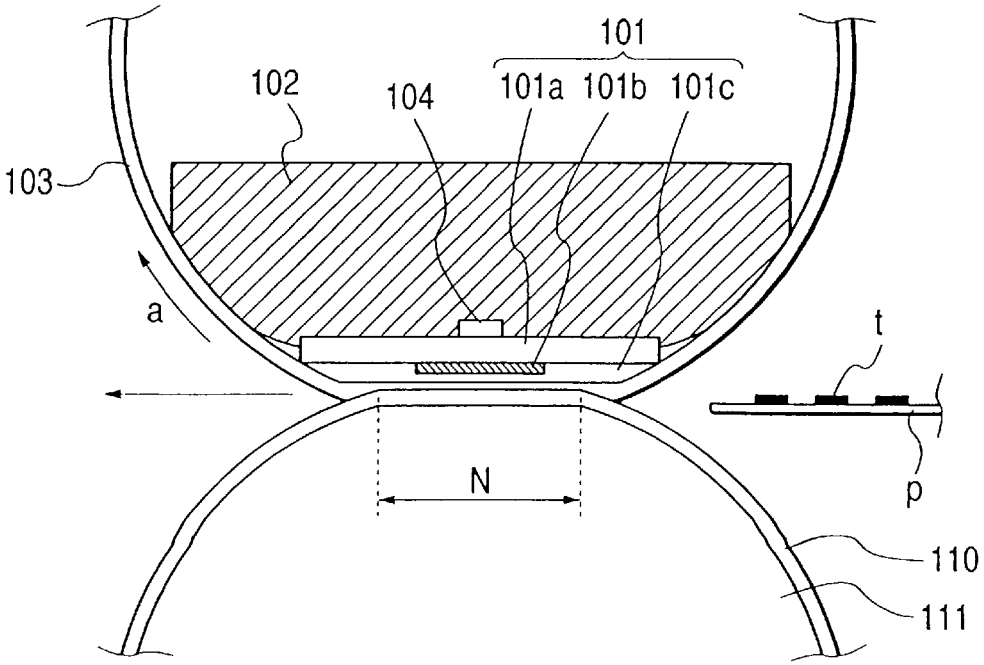
FIG. 13 PRIOR ART
FIG. 13 is a schematic view which shows a main portion of a heating and fixing device in accordance with the conventional art.

The same ceramic heater as that shown in FIG. 13 is used for the heater 11 as the heating member (details of the heater 11 is omitted in FIG. 3). For example, the ceramic heater is structured such as to form a heat generating resistance layer such as a silver palladium (Ag/Pb), Ta2N or the like on a surface of a ceramic substrate with an electrical insulating characteristic, a good thermal conductivity and a low thermal capacity such as an alumina or the like (a surface in the side opposing to the fixing film 13) along a longitudinal direction of a substrate (a direction perpendicular to the drawing) by means of a screen printing or the like, and cover the heat generating resistance layer forming surface with a thin glass protecting layer. The ceramic heater 11 is structured such that the heat generating resistance layer is heated by turning on electricity to the heat generating resistance layer and the whole heater including the ceramic substrate and the glass protecting layer is quickly heated. The temperature increase of the heater 11 is detected by temperature detecting means 14 disposed at the back surface of the heater and fed back to a current-carrying control portion (not shown). The current-carrying control portion controls a current-carrying with respect to the heat generating resistance layer in such a manner that a heater temperature detected by the temperature detecting means 14 is maintained at a preset substantially constant temperature (a fixing temperature, in this case 190° C.). Accordingly, the heater 11 is heated and adjusted to a preset fixing temperature during an image fixing operation.

In the heating apparatus of the film heating type using the thin film 13 for fixing, since the rigidity of the ceramic heater 11 as the heating member is high, the pressing roller 20 having the elastic layer 22 becomes flat at the press-contact portion in correspondence to the flat lower surface of the heater 11 pressing and contacting the pressing roller 20 so as to form the fixing nip portion N having a preset width. Accordingly, the heating and fixing with a quick start can be realized by heating only the fixing nip portion N.

(4) Experimental Embodiment

Figure 4A:
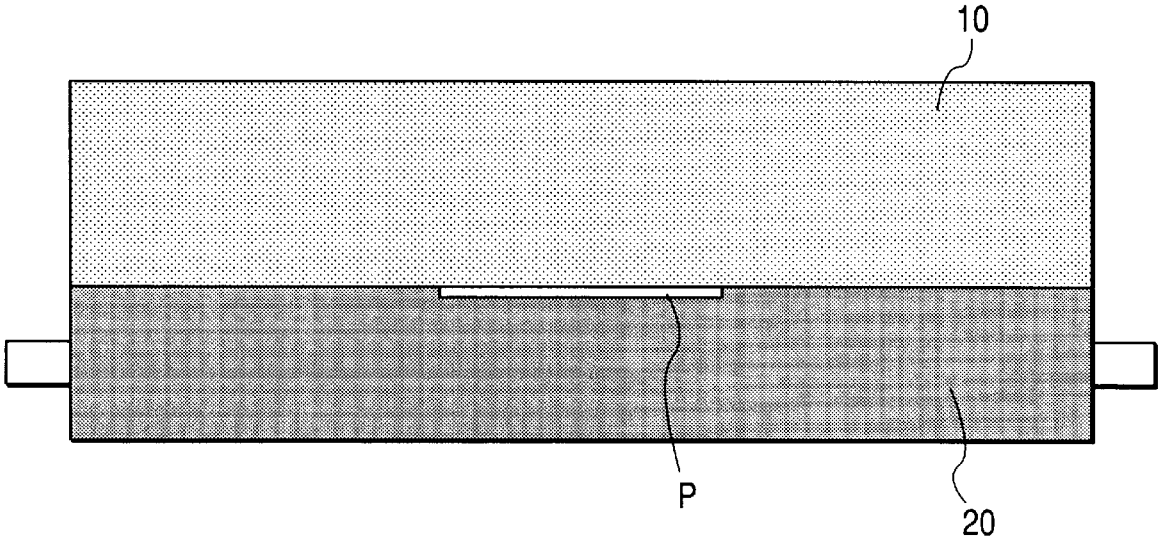
FIG. 4A is a schematic view which shows a fixing device at a time of feeding an envelope in a single manner.

Normally, in the heating and fixing apparatus 6 mentioned above, there is no gap between the ceramic heater 11 and the pressing roller 20 as shown in FIG. 4A at a time of a normal feeding of an envelope, so that an excessive temperature increase does not occur. However, in the case that an overlap-feed of the envelopes or the like is generated, a gap is generated between the ceramic heater 11 and the pressing roller 20 at a portion of not feeding papers, and an excessive temperature increase occurs, so that there is a case that a melting of the film guide 12, a breakage of the ceramic heater 11 and the like are caused.

Figure 5:
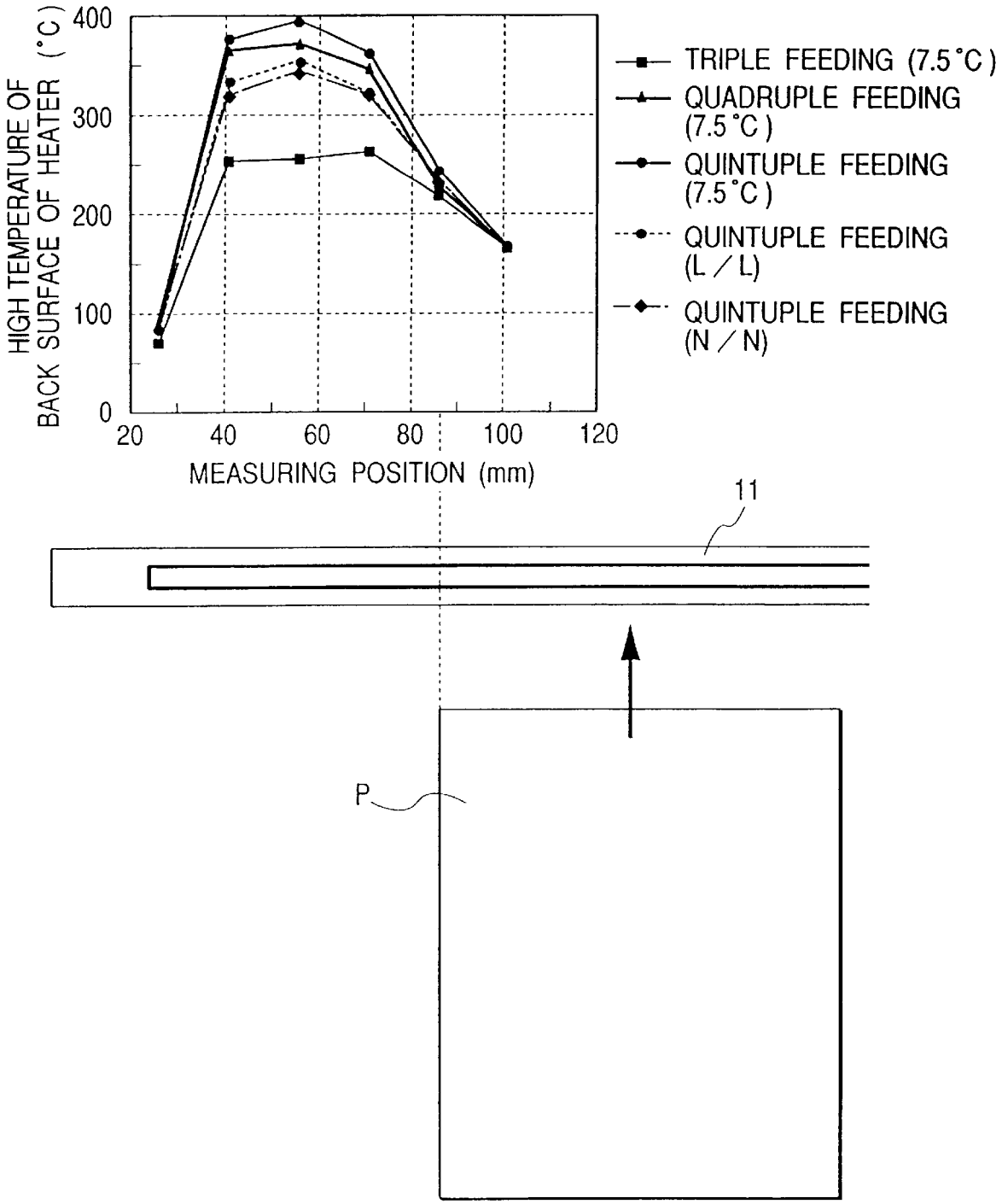
FIG. 5 is a graph and a schematic view which shows a temperature of a back surface of a heater at a time of feeding the envelopes in an overlap manner.

FIG. 5 shows a high temperature of a back surface of the ceramic heater 11 at a time of feeding the envelopes in an overlap manner. Further, the number of the overlap feedings and an environment by which the breakage of the ceramic heater is generated are shown in Table 1. In this case, the pressing roller used in this embodiment is structured such as to form a silicon rubber having a thickness of 4 mm on an iron core metal having a diameter of 12 mm, be coated with a PFA tube dispersed by a fluorine resin thereon and have a diameter of 20 mm and hardness of 41 degrees (Asker-C, at a time of applying a load of 500 g). An envelope (com10 (name of article)) is used for the paper.

TABLE 1

Whether or not breakage of ceramic heater is generated at a time of feeding envelopes in an overlap manner

| Number of overlap feeding of envelopes /Environment | N/N (23° C., 60%) | L/L (15° C., 10%) | Extreme low temperature (7.5° C., 50%) |
|---|---|---|---|
| Triple feeding | ○ | ○ | ○ |
| Quadruple feeding | ○ | ○ | ○ |
| Quintuple feeding | ○ | ○ | Δ |

○: None
Δ: There is a case of being generated
×: Generated

Figure 4B:
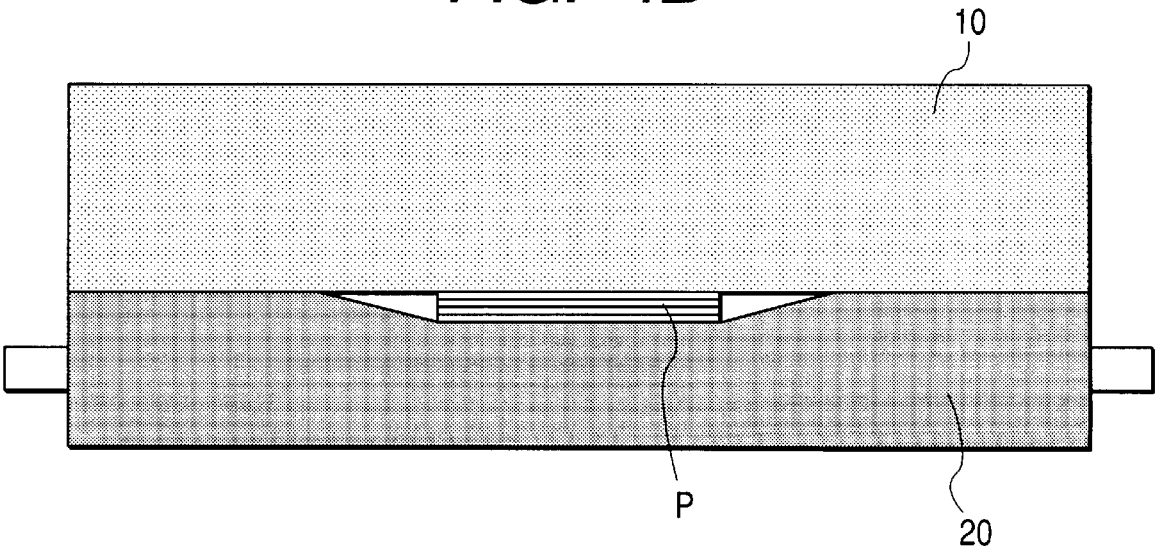
FIG. 4B is a schematic view which shows a fixing device at a time of feeding envelopes in an overlap manner.

It is understood from FIGS. 4A and 4B and Table 1 that an excessive temperature increase occurs on the back surface of the heater 11 at the portion of not feeding the paper under a condition of the quadruple and quintuple feedings of the envelopes. Further, under a low temperature environment, a supply power during feeding the papers is increased because the paper temperature is low, and a temperature increase at a floating portion is great, so that there is a case that a breakage is caused.

Figure 6A:
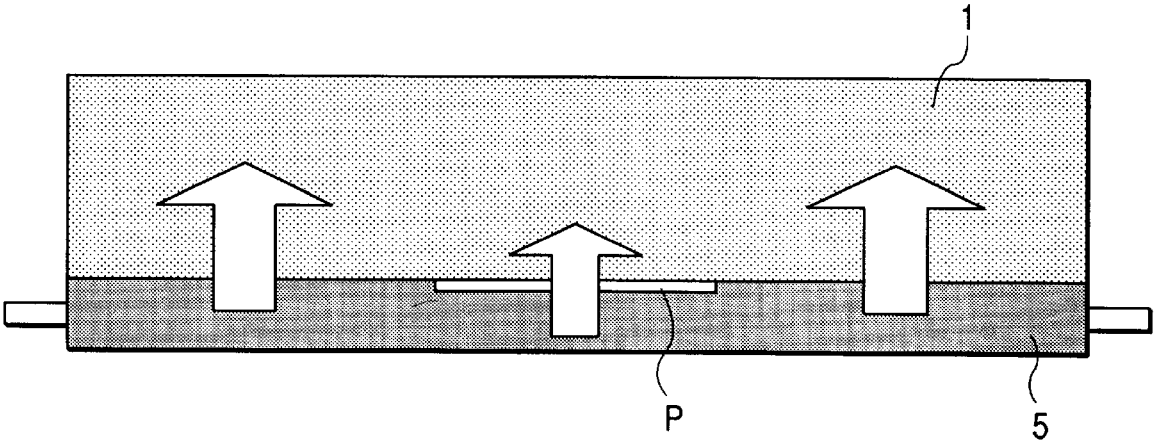
FIG. 6A is a schematic view which shows a transfer roller portion at a time of feeding the envelope in a single manner.
Figure 6B:
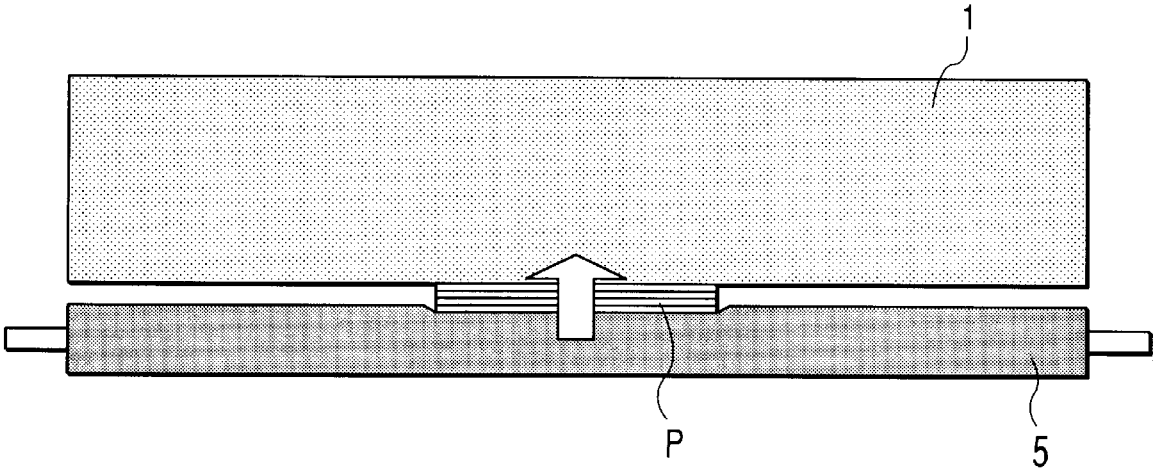
FIG. 6B is a schematic view which shows the transfer roller portion at a time of feeding the envelopes in an overlap manner.

On the contrary, in the transfer roller 5, in the case that the overlap feeding of the envelopes or the like is generated, since the drum and the transfer roller are apart from each other at the portion of not feeding the paper due to the paper thickness as shown in FIG. 6B, the current directly flowing from the transfer roller to the drum is lost, so that the transfer current is reduced in comparison with a time of feeding the envelope in a single manner (FIG. 6A). In addition, the paper thickness is increased in accordance with the overlap feeding, whereby the paper resistance is widely increased and the transfer current is significantly reduced.

Figure 7:
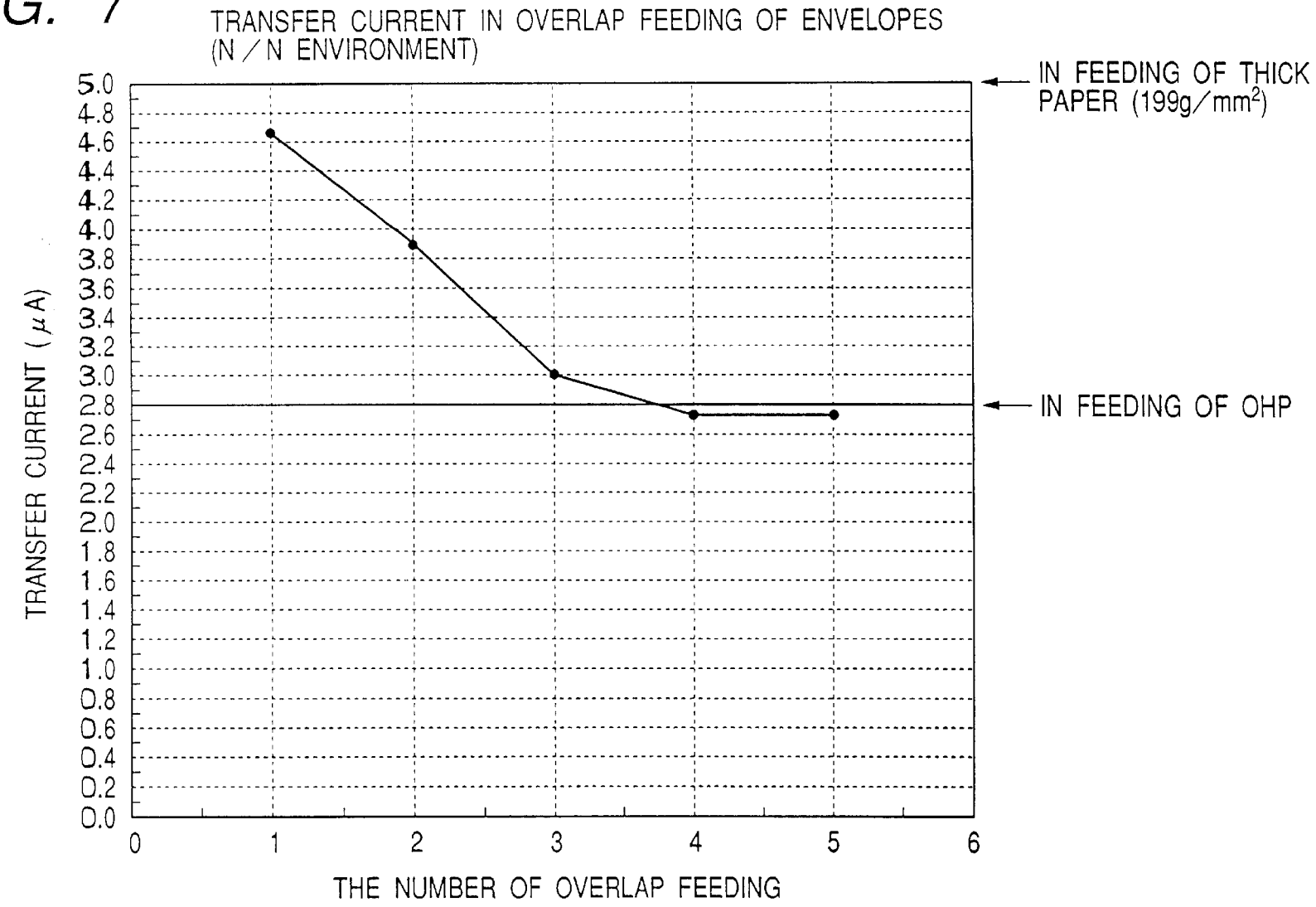
FIG. 7 is a graph which shows a transfer current at a time of feeding the envelopes in an overlap manner under an N/N environment.
Figure 8:
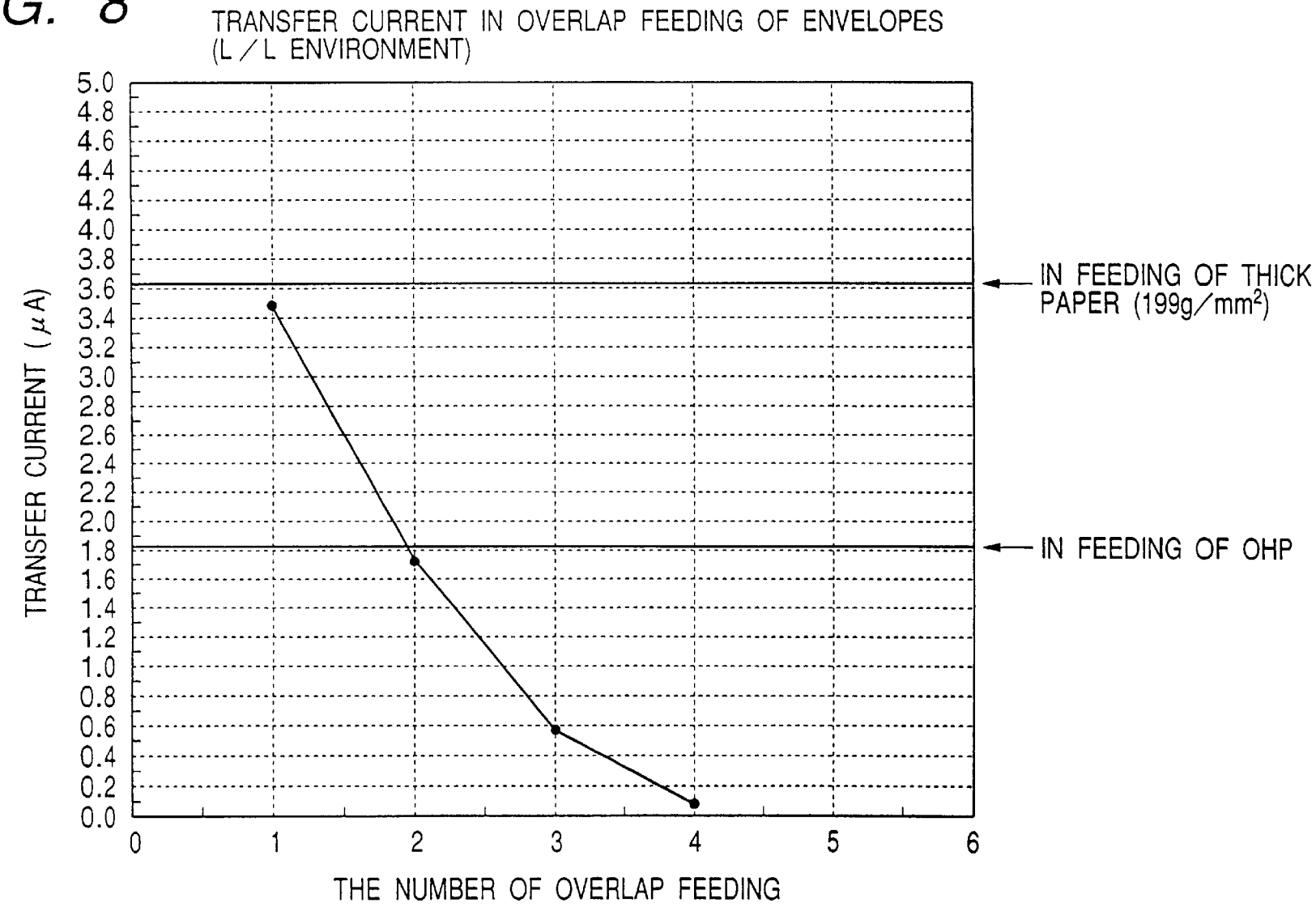
FIG. 8 is a graph which shows a transfer current at a time of feeding the envelopes in an overlap manner under an L/L environment.
Figure 9:
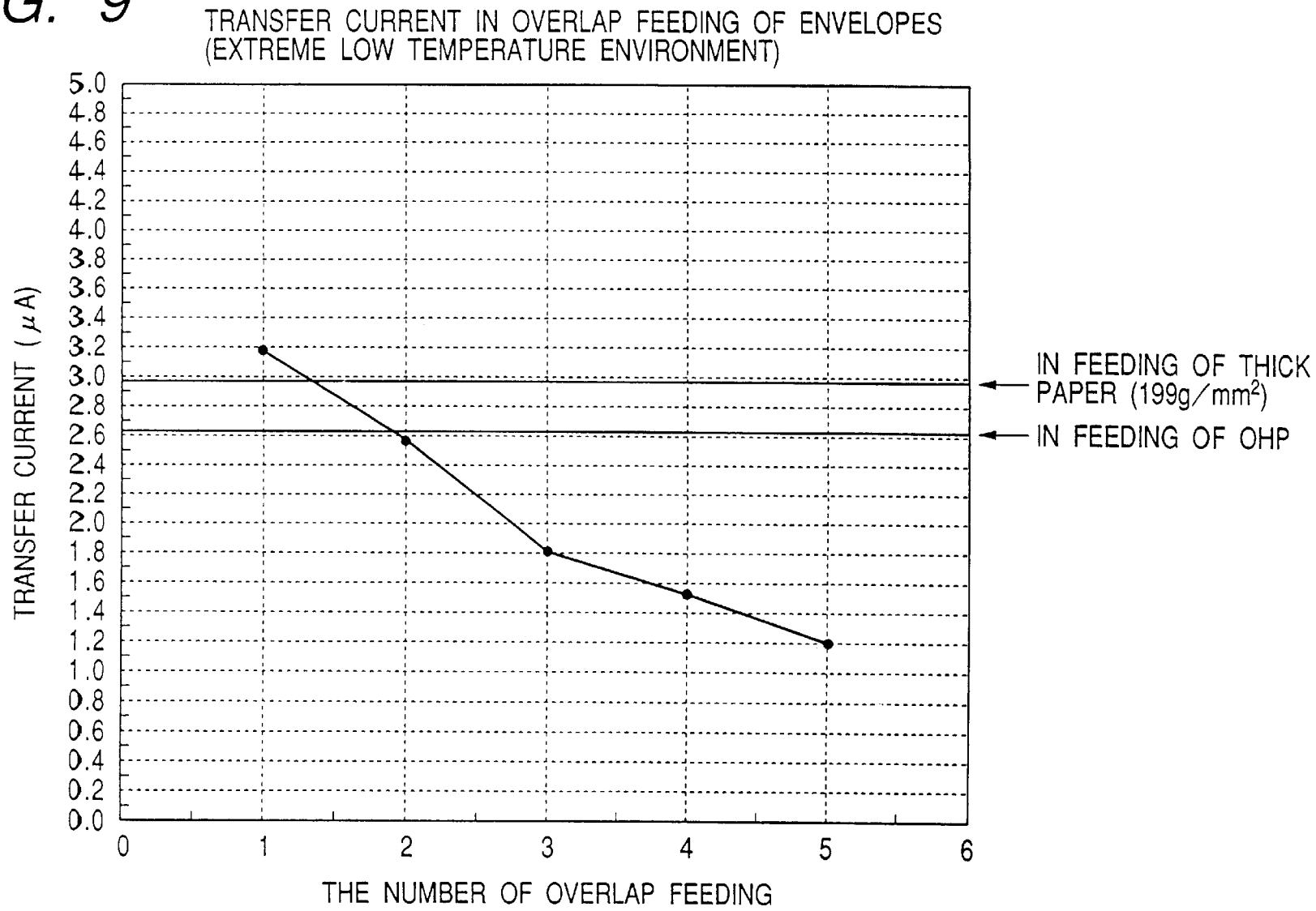
FIG. 9 is a graph which shows a transfer current at a time of feeding the envelopes in an overlap manner under an extreme low temperature environment.

FIGS. 7 to 9 show results obtained by the transfer current at a time of feeding the envelopes in an overlap manner under an N/N environment, an L/L environment and an extreme low temperature environment. In accordance with FIGS. 7 to 9, it is apparent that the transfer current becomes smaller than the thick paper and an OHP (a transparent resin sheet) having a small transfer current when the envelopes are fed in an overlap manner. Here, the transfer current becomes small under the L/L environment and the extreme low temperature environment because a moisture of the paper is reduced and a resistance is increased. In this case, the used transfer roller 5 is structured such as to form the elastic layer 5*b* by an NBR (a nitrile butadiene rubber) of an ion conductive type on an iron core metal 5*a* having a diameter of 6 mm and have a diameter of 15 mm and a hardness of 45 degrees (Asker-C, at a time of applying a load of 1 kg). Further, the resistance is set to be $3\times10^8$ Ω by adjusting the NBR. The transfer roller 5 is controlled to be a constant voltage at a time of transferring the image by 0.7 to 1.4 KV under the N/N environment, by 1.4 to 3.5 KV under the L/L environment and by 3.5 to 4.5 KV under the extreme low temperature.

The transfer current is started sampling 0.5 second after the transfer bias is applied, measured for 16 points (corresponding to about a periphery of the transfer roller) and determined as an average value.

Figure 10:
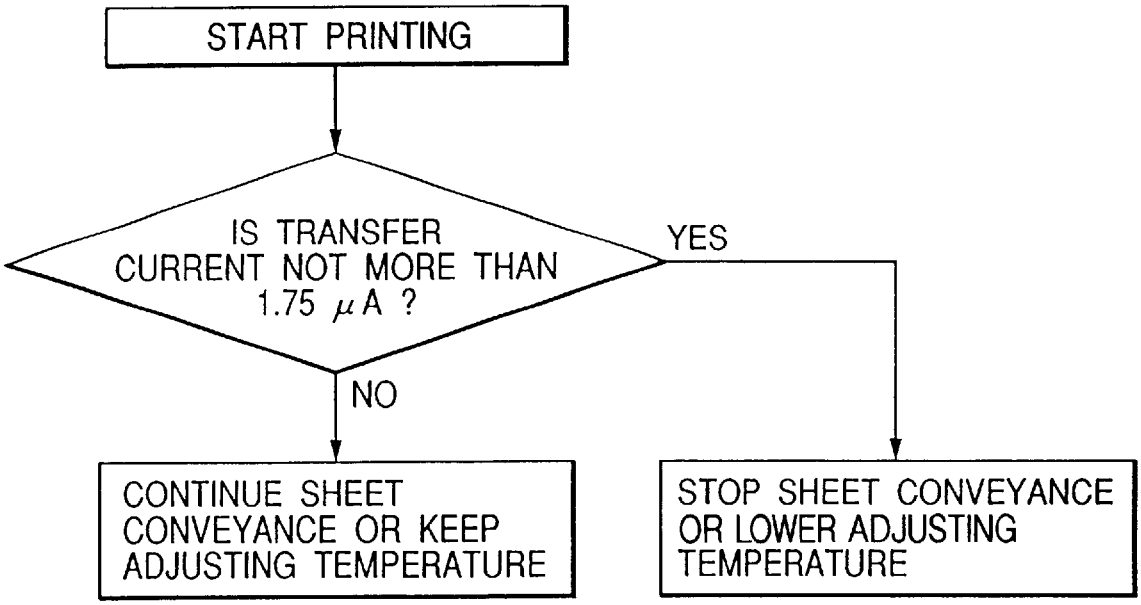
FIG. 10 is a flow chart which shows a control in accordance with the first embodiment.

As a result, a sequence is set such as to stop a paper conveyance by regarding as an overlap feeding of the envelopes in the case that the transfer current is 1.75 μA or less (refer to FIG. 10). Otherwise, it is structured such as to reduce the adjusting temperature of the fixing device at a degree of 20° C. (the set temperature is made 170° C.) in the case that the transfer current is 1.75 μA or less. It is preferable to display a jamming or the like and inform an operator at a time of stopping the paper conveyance.

In accordance with the sequence mentioned above, it is recognized that under the extreme low temperature environment, the quadruple and quintuple feedings of the envelopes can be detected and the paper conveyance is stopped, so that the papers is not conveyed to the fixing device, thereby preventing the ceramic heater 11 from breaking.

With reference to FIG. 8, the paper conveyance is stopped or the adjusting temperature is reduced even under the L/L environment in which the breakage of the heater is not generated as shown in Table 1 in accordance with this embodiment, however, even when the heater is not broken, such a structure is preferable in the case of considering a mechanical durability of the heater and a temperature durability.

Further, in accordance with this embodiment, since the transfer roller 5 is ATVC controlled, a voltage controlling the transfer roller 5 to be a constant voltage in accordance with an environment is variable, however, since the resistance change of the transfer roller 5 is considered for judging the overlap feeding, a judgement of the overlap feeding can be more accurately performed in comparison with the case of not performing the ATVC control.

Second Embodiment

In accordance with this embodiment, in order that the drum and the transfer roller are sufficiently apart from each other at a time of feeding the envelopes in an overlap manner and a reduction of the transfer current can be accurately detected, a hardness of the transfer roller is set to be 50 degrees or more (Asker-C, at a time of applying a load of 1 kg) and a lack of uniformity of resistance in the rotating direction of the transfer roller 5 is set to be 1.2 or less. In this case, the other structures, operations and conditions of the apparatus are the same as those of the first embodiment mentioned above, and a repetitive description will be omitted.

As mentioned above, in order to accurately detect the overlap feeding of the envelopes, it is necessary that the drum and the transfer roller are sufficiently apart from each other at a time of feeding the envelopes in an overlap manner. Further, since it is necessary that a transfer current monitor also detects at a time of paper conveyance before the paper reaches the fixing device, it is required to detect for a time corresponding to about a periphery of the transfer roller. Accordingly, it is necessary that a hardness of the transfer roller is certainly high and a lack of uniformity of the resistance in a peripheral direction is small.

In accordance with the first embodiment mentioned above, since the transfer roller having a hardness of 45 degrees comparatively low for the solid transfer roller and a lack of uniformity of the periphery in a rotational direction of 1.4 is used, there has been a case that the overlap feeding of the envelopes can not be detected.

Then, at first, in the transfer roller having an NBR solid rubber having a different hardness as shown in Table 2, whether or not the overlap feeding of the envelopes can be detected is searched. The results are shown in Table 3.

TABLE 2

| Transfer roller | Roller hardness | Lack of uniformity of periphery of resistance in rotational direction |
|---|---|---|
| A solid roller | 40 | 1.2 |
| B solid roller | 45 | 1.2 |
| C solid roller | 50 | 1.2 |
| D solid roller | 55 | 1.2 |

TABLE 3

| | Whether or not overlap feeding of envelopes can be detected | | | |
|---|---|---|---|---|
| Transfer roller | A | B | C | D |
| Triple feeding | × | × | × | Δ |
| Quadruple feeding | × | × | Δ | ○ |
| Quintuple feeding | × | Δ | ○ | ○ |

×: Not detected
Δ: There is a case of not being detected
○: Detected

In accordance with Table 3 mentioned above, in order to more accurately detect the overlap feeding, it is apparent that the hardness of the transfer roller is preferably 50 degrees or more.

Next, by using the transfer roller having an NBR solid rubber having a different lack of uniformity in a peripheral direction as shown in Table 4, whether or not the overlap feeding of the envelopes can be detected is searched. The results are shown in Table 5.

TABLE 4

| Transfer roller 5 | Hardness | Lack of uniformity of periphery of resistance in rotational direction |
|---|---|---|
| E solid roller | Fifty degrees | 1.1 |
| F solid roller | Fifty degrees | 1.2 |
| G solid roller | Fifty degrees | 1.3 |
| H solid roller | Fifty degrees | 1.4 |

TABLE 5

| | Whether or not overlap feeding of envelopes can be detected | | | |
|---|---|---|---|---|
| Transfer roller | E | F | G | H |
| Detected or not | ○ | ○ | Δ | Δ |

Δ: There is a case of not being detected
○: Detected

As mentioned above, in order to accurately detect the overlap feeding, it is preferable that the lack of uniformity of the resistance in a peripheral direction. is 1.2 or less.

In accordance with the above description, in order to accurately detect the overlap feeding of the envelopes, it is understood that the hardness of the transfer roller is preferably 50 degrees or more and the lack of uniformity of the resistance in the rotational direction is preferably 1.2 or less.

Third Embodiment

In accordance with this embodiment, a threshold of the transfer current is changed in correspondence to an applied bias (which is changed in response to the resistance of the transfer roller). In this case, the other conditions are the same as those of the embodiment mentioned above, and a repetitive description will be omitted.

It has been known that in the case of using a roller comprising an ion conductive type NBR as the transfer roller 5, a resistance is changed due to a temperature and a humidity of the using environment. Accordingly, there is performed an ATVC control structured such as to change the transfer voltage in correspondence to the voltage during the constant current control operation (which is changed in correspondence to the resistance of the transfer roller) for supplying a desired transfer current to a paper when the transfer member does not exist in the transfer nip portion. Table 6 shows a relation between a resistance of the transfer roller and the transfer voltage under each of the environments. This can be applied to the first embodiment.

TABLE 6

| | Relation between resistance of transfer roller and transfer voltage under each of environments | |
|---|---|---|
| Environment | Resistance of roller | Transfer voltage |
| N/N | $8 \times 10^7$ to $3 \times 10^8$ | 0.7 to 1.4 kv |
| L/L | $3 \times 10^8$ to $8 \times 10^8$ | 1.4 to 3.5 kv |
| Extreme low temperature | $8 \times 10^8$ to $3 \times 10^9$ | 3.5 to 4.5 kv |

As is understood from Table 6, the using environment will be substantially apparent from the transfer voltage (the resistance of the transfer roller), so that a threshold of the transfer current can be determined.

Table 7 shows a threshold of the transfer current at each of the transfer voltages obtained by Table 6 and FIGS. 7 and 8.

TABLE 7

| Threshold of transfer current at each of transfer voltages (resistances of transfer rollers) | |
|---|---|
| Transfer voltage | Threshold of transfer current |
| 0.7 to 1.4 kv | 2.8 μA |
| 1.4 to 4.5 kv | 1.75 μA |

A detection of the overlap feeding of the envelopes can be performed under the N/N environment by setting the threshold of the transfer current in a manner shown in Table 7. However, in the above case, since there is a high possibility of an erroneous detection in the case of the OHP sheet under the N/N environment, a sequence is set such as to 20° C. reduce a temperature of setting the fixing to 170° C. from a normally set 190° C. at a time of detecting, thereby feeding the paper.

Figure 11:
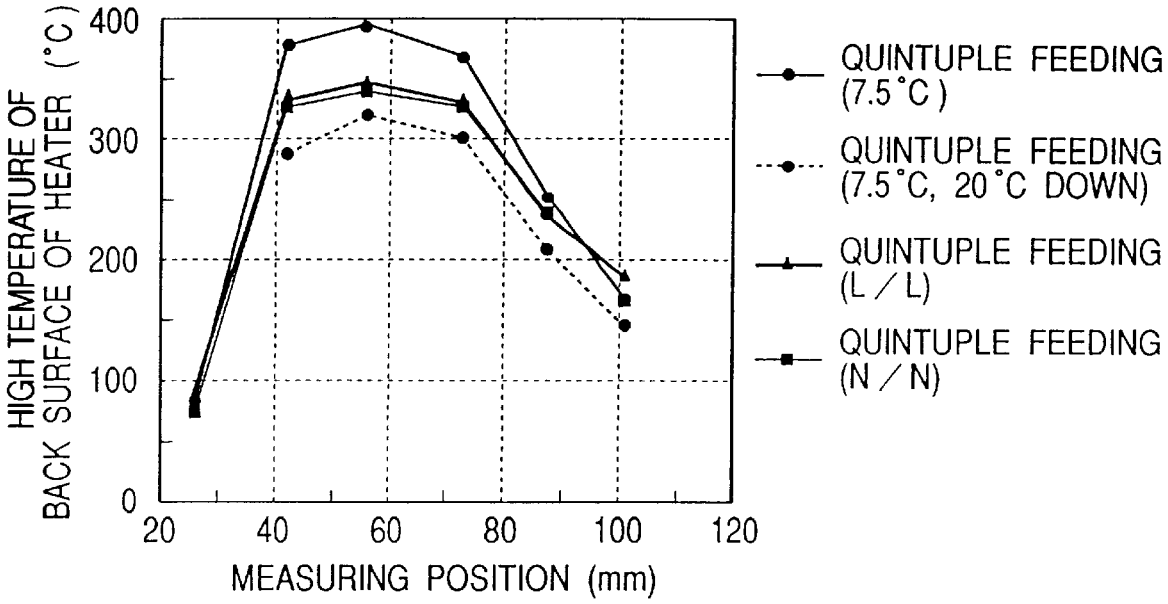
FIG. 11 is a graph which shows a dependence upon a fixing temperature of a reaching temperature of a back surface of a heater at a time of feeding the envelopes in an overlap manner.
Figure 12:
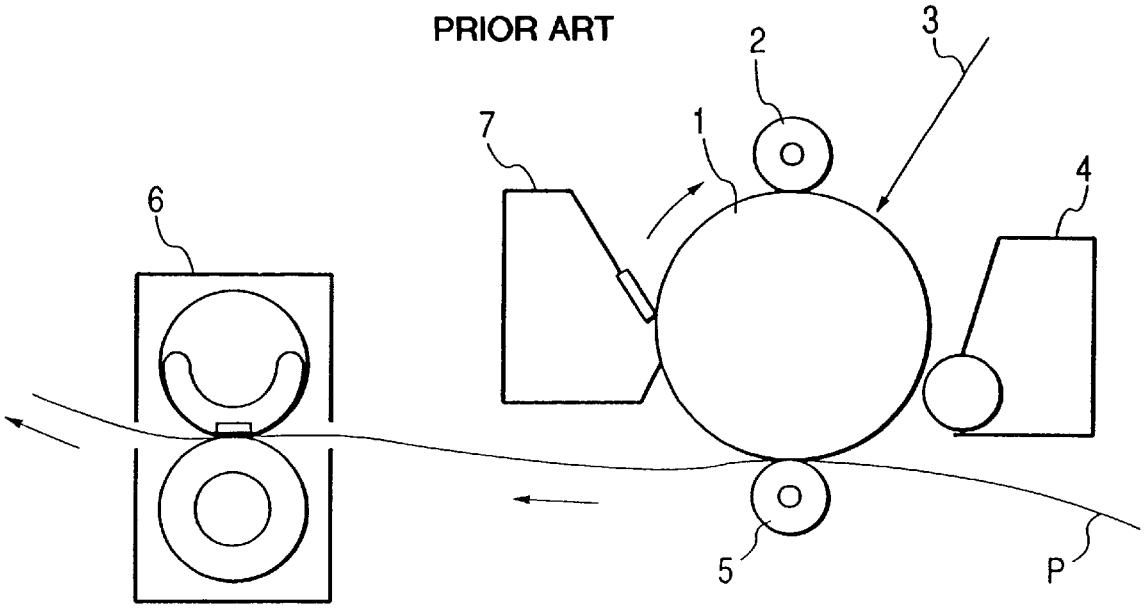
FIG. 12 PRIOR ART
FIG. 12 is a schematic view of an image forming apparatus in accordance with a conventional art.

A temperature of the back surface of the heater at a time of feeding the envelopes in an overlap manner at this time is shown in FIG. 11. Accordingly, it is apparent that an excessive temperature increase of the portion of not passing the papers can be prevented even at a time of feeding the envelopes in an overlap manner.

In accordance with the sequence mentioned above, it is recognized that the quadruple feeding or more can be certainly detected under the N/N, L/L and extreme low temperature environments, so that the ceramic heater can be prevented from breaking.

Here, particularly, even in the case that the heater is not immediately broken under the N/N environment, taking a mechanical durability and a temperature durability of the heater into consideration, it is preferable to stop the paper conveyance and reduce the moisture adjusting temperature.

Fourth Embodiment

In accordance with this embodiment, it is structured such that the threshold of the transfer current mentioned above is changed by a paper supply port of the image forming apparatus. In this case, the other conditions are the same as those of the embodiment, and a repetitive description will be omitted.

The transfer current is different in accordance with a kind of the paper and a thickness of the paper, and becomes small in a paper having a high resistance such as an OHP sheet, a thick paper or the like. Accordingly, in printing from the paper supply port such as a multi paper (MP) tray 21 shown in FIG. 1 through which a special paper such as a thick paper, an OHP sheet, an envelope or the like is inserted, there is a case that the transfer current becomes small even in the other cases than the overlap feeding of the envelopes. On the contrary, in an exclusive feeder 30 for an envelope, a kind of papers for conveyance is limited to an environment, so that there is no case that the transfer current becomes small without the case of feeding in an overlap manner.

Since a transfer performance for the transfer material by the exclusive feeder 30 for the envelope is set greater than a transfer performance by the MP tray 21, the overlap feeding is generated in the case of the exclusive feeder 30 for the envelope at higher possibility. Further, the number of the transfer materials fed in an overlap manner is also greater in the case of the envelope feeder at higher possibility.

FIGS. 7 to 9 show a transfer current at a time of printing a thick paper or an OHP sheet. As is understood from FIGS. 7 to 9, there is a case that the transfer current at a time of feeding the thick paper or the OHP sheet becomes a value close to the value at a time of feeding the envelopes in an overlap manner.

Accordingly, in this embodiment, a threshold of the transfer current is determined in a manner shown in a below table.

TABLE 8

| Threshold of transfer current in accordance with paper supply port | |
|---|---|
| Paper supply port | Threshold of transfer current |
| MP tray | 1.75 μA |
| Envelope feeder | 2.2 μA |

A sequence is set such that in the case that the paper supply port is the envelope feeder and equal to or less than the threshold of the transfer current in Table 8 at a time of transferring the image, it is regarded as an overlap feeding of the envelopes, thereby stopping a paper conveyance. Further, a sequence is set such that in the case that the paper supply port is the MP tray and equal to or less than the threshold of the transfer current in Table 8, the set temperature for fixing is 20° C. reduced to 170° C. from a 190° C. at a normal case.

In accordance with the sequence mentioned above, it is recognized that the overlap feeding equal to or more than triple feeding can be detected at a time of using the envelope feeder, thereby preventing the ceramic heater 11 from being given an unnecessary damage, and at a time of feeding the paper by the MP tray 21, an erroneous detection by the other sheets such as the thick paper and the OHP sheet than the envelope can be prevented.

Fifth Embodiment

In accordance with this embodiment, it is structured such that the threshold of the transfer current mentioned above is changed in response to the information for designating the paper size performed by a user. In this case, the other conditions are the same as those of the embodiment mentioned above, and a repetitive description will be omitted.

In the case of printing from the MP tray 21, the user designates the paper size, however, an erroneous detection of the paper sizes between A4 and LTR type can be prevented by changing the threshold of the transfer current on the basis of the paper size information selected by the user.

The threshold of the transfer current on the basis of the designation of the paper size is shown in the below table.

TABLE 9

| Threshold of transfer current on the basis of paper size designation | |
|---|---|
| Designation of paper size | Threshold of transfer current |
| A4, LTR, LGL | 1.5 μA |
| Other than A4, LTR and LGL | 1.76 μA |

*Including case of not designating paper size

A sequence is set such that in the case that the transfer current is equal to or less than the value shown in Table 9, it is regarded as an overlap feeding of the envelopes, thereby stopping a paper conveyance. In this case, at a time of designating A4, LTR (letter) and LGL (legal), there is also a possibility of erroneously designating a size, so that an overlap feeding of an envelope is performed.

As a result of conveying the envelope and the paper of A4 and LTR type, it is recognized that an erroneous detection of the sheets such as A4, LTR type thick paper and an OHP sheet other than the envelope is reduced, and the overlap feeding can be accurately detected.

Sixth Embodiment

In accordance with this embodiment, it is structured such that in the case of having a plurality of fixing modes, the threshold of the transfer current mentioned above is changed on the basis of the fixing mode. In this case, the other conditions are the same as those of the embodiment mentioned above, and a repetitive description will be omitted.

In this embodiment, there is a fixing mode corresponding to a special paper such as a rough paper mode for securing a fixing performance of a bond paper and a thick paper having a bad surface characteristic (a mode for increasing a set temperature for fixing in comparison with a normal mode or for widening a paper supply interval (an interval between a transfer material at a time of continuously printing and the next transfer material)), an OHP mode for preventing the OHP sheets from attaching to each other due to adhesion of a toner because of a too good fixing performance of the OHP (a mode for decreasing a set temperature for fixing in comparison with a normal mode) and the like. In the case that the user designates these modes, the erroneous detection of the thick paper and the OHP sheet can be prevented by changing the threshold of the transfer current on the basis of the information.

A threshold of the transfer current in each of the fixing modes is determined as Table 10 in accordance with FIGS. 7 to 9.

TABLE 10

Threshold of transfer current in each of fixing modes

| Fixing mode | Threshold of transfer current |
|---|---|
| Rough paper mode | 1.5 μA |
| Normal mode | 1.76 μA |
| OHP mode | 1.5 μA |

As a result of testing a conveyance of a thick paper, an OHP sheet and an envelope on the basis of the sequence mentioned above, it is recognized that an erroneous detection of the sheets such as a thick paper and an OHP sheet other than the envelope can be prevented, and the overlap feeding can be accurately detected.

Seventh Embodiment

In accordance with this embodiment, it is structured such that whether or not the overlap detection mentioned above is performed is determined on the basis of a detected temperature of the fixing device at a time when a print starting signal is input to the apparatus. In this case, the other conditions are the same as those of the embodiment mentioned above, and a repetitive description will be omitted. The print starting signal may be input by a copy button in the image forming apparatus itself, a computer connected to the image forming apparatus, a work processor or the like.

A breakage of the ceramic heater 11 at a time of feeding the envelopes in an overlap manner is easily generated particularly in the case of starting a print from a state that the fixing device is cooled. Accordingly, the heater breakage is generated due to a thermal stress caused by a local temperature increase near the end portions of the envelopes fed in an overlap manner in a state that the fixing device is wholly cooled.

A relation of a temperature of the fixing device at a time of starting a print in the case that the heater breakage is generated at a time of feeding in an overlap manner is shown in Table 11.

TABLE 11

Relation between temperature at a time of starting print and heater breakage

| Temperature of ceramic heater | Heater breakage |
|---|---|
| 80° C. | ○ |
| 70° C. | Δ |
| 60° C. | Δ |

Δ: There is a case of generation
○: No generation

As is understood from Table 11, in the case of 80° C. or more, a breakage is not generated even when the overlap feeding of the envelopes is generated.

Then, the structure is made such that the overlap detection sequence the same as that of the embodiment mentioned above (a paper conveyance is stopped or a set temperature of the fixing device is descended in comparison with the normal mode) is performed only in the case that the heater temperature is 80° C. or less.

In accordance with the sequence mentioned above, it is recognized that an erroneous detection of a thick paper and an OHP sheet is not generated in almost every cases as well as a breakage of a ceramic heater due to an overlap feeding of the envelopes can be prevented.

Here, in all the embodiments mentioned above, the transfer roller 5 is controlled to be a constant voltage during an image transferring, however, the transfer roller can be controlled to be a constant current by ignoring a memory caused by a direct supply of a current to the photosensitive material from the transfer roller without passing through the transfer material. In this case, a sequence of detecting the overlap feeding detection of the envelopes may determine whether or not the detection is performed in accordance with monitoring a voltage generated in the transfer roller 5 during the image transferring. Accordingly, whether or not the envelopes are fed in an overlap manner at the transfer nip portion can be estimated on the basis of a change of an impedance between the image carrier and the transfer roller during the image transferring (a change of a characteristic between a voltage and a current of the transfer roller). In this case, it is preferable that the current in the constant current control is determined by the ATVC control.

The present invention is not limited to the embodiments mentioned above, and includes modifications of the same technical ideas.

What is claimed is:

1. An image forming apparatus comprising:

image forming means for forming an image on a recording material;

fixing means for fixing the image on the recording material, wherein said fixing means is maintained a set temperature during an image fixing operation;

overlap-feed detecting means for detecting an overlap-feed of the recording material conveyed to said fixing means; and set temperature control means for controlling the set temperature, wherein said control means lowers the set temperature when said overlap-feed detecting means detects the overlap feed.

2. An image forming apparatus according to claim 1, wherein said apparatus determines whether or not a detection of the overlap-feed is performed in accordance with a temperature of said fixing means when an image forming start signal is input.

3. An image forming apparatus according to claim 1, wherein said fixing means has a heater generating a heat by turning on electricity, a film moving while being in contact with said heater, and a back-up member forming a nip for holding and conveying the recording material together with said heater via said film, and said heater is maintained at the set temperature during the image fixing operation.

4. An image forming apparatus comprising:

image forming means for forming an image on a recording material;

fixing means for fixing the image on the recording material;

overlap-feed detecting means for detecting an overlap-feed of the recording material conveyed to said fixing means; and conveyance control means for controlling a conveyance of the recording material, wherein said conveyance control means stops the conveyance of the recording materials when said overlap-feed detecting means detects the overlap feed, wherein said apparatus determines whether or not a detection of the overlap-feed is Performed in accordance with a temperature of said fixing means when an image forming start signal is input.

5. An image forming apparatus according to claim 4, wherein said fixing means has a heater generating a heat by turning on electricity, a film moving while being in contact with said heater, and a back-up member forming a nip for holding and conveying the recording material together with said heater via said film.

6. An image forming apparatus comprising:

image forming means for forming an image on a recording material, wherein said image forming means has a transfer member for transferring the image on the recording material;

fixing means for fixing the image on the recording material, wherein said fixing means is maintained at a set temperature during an image fixing operation; and set temperature control means for controlling the set temperature, wherein said control means sets the set temperature in accordance with an amount of current flowing to said transfer member when the image is transferred on the recording material.

7. An image forming apparatus according to claim 6, wherein said control means lowers the set temperature when the current is less than a predetermined value.

8. An image forming apparatus according to claim 7, wherein said transfer member is controlled to be a constant voltage by a predetermined voltage when the image is transferred on the recording material.

9. An image forming apparatus according to claim 8, wherein the predetermined voltage is set on the basis of a current flowing through said transfer member when the recording material is not present at a transfer position.

10. An image forming apparatus according to claim 8, wherein said transfer member is controlled to be a constant current when the recording material is not at a transfer position, and the predetermined voltage is set on the basis of a voltage applied to said transfer member during the constant current control.

11. An image forming apparatus according to claim 8, wherein the predetermined value is variable in accordance with the predetermined voltage.

12. An image forming apparatus according to claim 7, wherein said apparatus further has a first paper supply portion for supplying an envelope and a second paper supply portion for supplying an ordinary paper, and the predetermined value is different in accordance with which of said first paper supply portion and said second paper supply portion is used.

13. An image forming apparatus according to claim 7, wherein the predetermined value is different in accordance with a size of the recording material.

14. An image forming apparatus according to claim 7, wherein said fixing means has a plurality of fixing modes having different fixing conditions, and the predetermined value is variable in accordance with a fixing mode to be selected.

15. An image forming apparatus according to claim 14, wherein the fixing mode is variable in accordance with a kind of a recording material to be used.

16. An image forming apparatus according to claim 6, wherein said control means sets the set temperature in accordance with both of a temperature of said fixing means when an image forming start signal is input, and a current flowing through said transfer member.

17. An image forming apparatus according to claim 6, wherein said image forming means has an image bearing member, and said transfer member is brought into press contact with said image bearing member and has an ASKER-C hardness of 50 degrees or more.

18. An image forming apparatus according to claim 6, wherein said transfer member has a roller shape.

19. An image forming apparatus according to claim 6, wherein said fixing means has a heater generating a heat by turning on electricity, a film moving while being in contact with said heater, and a back-up member forming a nip for holding and conveying the recording material together with said heater through said film, and said heater is maintained at the set temperature during the image fixing operation.

20. An image forming apparatus comprising:

image forming means for forming an image on a recording material, wherein said image forming means has a transfer member for transferring the image on the recording material;

fixing means for fixing the image on the recording material; and conveyance control means for controlling a conveyance of the recording material, wherein said conveyance control means controls the conveyance of the recording materials in accordance with an amount of current flowing to said transfer member when the image is transferred on the recording material.

21. An image forming apparatus according to claim 20, wherein said control means stops conveying the recording material when the current is smaller than a predetermined value.

22. An image forming apparatus according to claim 21, wherein said transfer member is controlled to be a constant voltage by a predetermined voltage when the image is transferred on the recording material.

23. An image forming apparatus according to claim 22, wherein the predetermined voltage is set on the basis of a current flowing through said transfer member when the recording material is not at a transfer position.

24. An image forming apparatus according to claim 22, wherein said transfer member is controlled to be a constant current when the recording material is not at a transfer position, and the predetermined voltage is set on the basis of a voltage applied to said transfer member during the constant current control.

25. An image forming apparatus according to claim 22, wherein the predetermined value is variable in accordance with the predetermined voltage.

26. An image forming apparatus according to claim 21, wherein said apparatus further has a first paper supply portion for supplying an envelope and a second paper supply portion for supplying an ordinary paper, and the predetermined value is different in accordance with which of said first paper supply portion and said second paper supply portion is used.

27. An image forming apparatus according to claim 21, wherein the predetermined value is different in accordance with a size of the recording material.

28. An image forming apparatus according to claim 21, wherein said fixing means has a plurality of fixing modes having different fixing conditions, and the predetermined value is variable in accordance with a fixing mode to be selected.

29. An image forming apparatus according to claim 28, wherein the fixing mode is variable in accordance with a kind of a used recording material.

30. An image forming apparatus according to claim 20, wherein said image forming means has an image bearing member and said transfer member is brought into press contact with said image bearing member and has an ASKER-C hardness of 50 degrees or more.

31. An image forming apparatus according to claim 20, wherein said transfer member has a roller shape.

32. An image forming apparatus according to claim 20, wherein said fixing means has a heater generating a heat by turning on electricity, a film moving while being in contact with said heater, and a back-up member forming a nip for holding and conveying the recording material together with said heater via said film.

33. An image forming apparatus comprising:

image forming means for forming an image on a recording material, wherein said image forming means has a transfer member for transferring the image on the recording material;

fixing means for fixing the image on the recording material, said fixing means being maintained at a set temperature during an image fixing operation;

set temperature control means for controlling the set temperature, wherein said control means sets the set temperature in accordance with an amount of voltage applied to said transfer member when the image is transferred on the recording material.

34. An image forming apparatus according to claim 33, wherein said transfer member is controlled to be a constant current by a predetermined current when the image is transferred on the recording material.

35. An image forming apparatus according to claim 33, wherein said fixing means has a heater generating a heat by turning on electricity, a film moving while being in contact with said heater, and a back-up member forming a nip for holding and conveying the recording material together with said heater via said film, and said heater is maintained at the set temperature during the image fixing operation.

36. An image forming apparatus comprising:

image forming means for forming an image on a recording material, wherein said image forming means has a transfer member for transferring the image on the recording material;

fixing means for fixing the image on the recording material;

conveyance control means for controlling a conveyance to the recording material, wherein said control means controls the conveyance of the recording material in accordance with an amount of voltage applied to the transfer member when the image is transferred on the recording material.

37. An image forming apparatus according to claim 36, wherein said transfer member is controlled to be a constant current by a predetermined current at a time of transferring the image on the recording material.

38. An image forming apparatus according to claim 36, wherein said fixing means has a heater generating a heat by turning on electricity, a film moving while being in contact with said heater, and a back-up member forming a nip for holding and conveying the recording material together with said heater via said film, and said heater is maintained at the set temperature during the image fixing operation.

* * * * *

UNITED STATES PATENT AND TRADEMARK OFFICE

CERTIFICATE OF CORRECTION

PATENT NO. : 5,991,555

DATED : November 23, 1999

INVENTOR(S): MASAHIKO SUZUMI, ET AL.

It is certified that error appears in the above-identified patent and that said Letters Patent is hereby corrected as shown below:

COLUMN 1:
Line 33, "cross sectional" --cross-sectional--; and
Line 50, "transferred" should read --transferred to--.

COLUMN 2:
Line 47, "a" should read --an--;
Line 58, "pealed" should read --peeled--; and
Line 65, "(Ag/Pb), Ta2N" should read --(Ag/Pd), $Ta_2N$"--.

COLUMN 3:
Line 40, "perphloroalkoxide" should read --perfluoroalkoxide--.

COLUMN 4:
Line 19, "descending" should read --lowering--.

COLUMN 8:
Line 50, "(Ag/Pb), Ta2N" should read --(Ag/Pd), $Ta_2N$"--.

COLUMN 15:
Line 62, "work" should read --word--.

UNITED STATES PATENT AND TRADEMARK OFFICE

CERTIFICATE OF CORRECTION

PATENT NO. : 5,991,555

DATED : November 23, 1999

INVENTOR(S): MASAHIKO SUZUMI, ET AL.

It is certified that error appears in the above-identified patent and that said Letters Patent is hereby corrected as shown below:

COLUMN 16:
Line 27, "descended" should read --lowered--;
Line 33, "cases" should read --case--; and
Line 63, "maintained" should read --maintained at--.

COLUMN 17:
Line 31, "Performed" should read --performed--.

COLUMN 20:
Line 3, "operation;"should read --operation; and--; and
Line 26, "rial;" should read --rial; and--.

Signed and Sealed this

Twenty-fourth Day of October, 2000

*Attest:*

Q. TODD DICKINSON

*Attesting Officer*

*Director of Patents and Trademarks*